US006669519B2

(12) United States Patent
Metrot

(10) Patent No.: US 6,669,519 B2
(45) Date of Patent: Dec. 30, 2003

(54) METHODS FOR MANUFACTURING A STRUCTURAL SUB-ASSEMBLY AND A GLIDING BOARD; STRUCTURAL SUB-ASSEMBLY AND GLIDING BOARD MADE BY SUCH METHODS

(75) Inventor: Eric Metrot, Bicton (AU)

(73) Assignee: Salomon S.A., Metz-Tessy (FR)

( * ) Notice: Subject to any disclaimer, the term of this patent is extended or adjusted under 35 U.S.C. 154(b) by 0 days.

(21) Appl. No.: 10/321,391

(22) Filed: Dec. 18, 2002

(65) Prior Publication Data

US 2003/0114054 A1 Jun. 19, 2003

(30) Foreign Application Priority Data

Dec. 19, 2001 (FR) ..... 01 16965

(51) Int. Cl.[7] ..... B63B 35/79

(52) U.S. Cl. ..... 441/65; 114/39.14; 114/357; 441/74

(58) Field of Search ..... 114/357, 39.14; 441/65, 68, 74, 79

(56) References Cited

U.S. PATENT DOCUMENTS 3,514,798 A 6/1970 Ellis ..... 9/310
4,244,156 A * 1/1981 Watts, Jr. ..... 52/746.1
4,964,825 A * 10/1990 Paccoret et al. ..... 441/74
5,840,407 A * 11/1998 Futhey et al. ..... 428/167
2002/0151233 A1 10/2002 Renard et al.

FOREIGN PATENT DOCUMENTS

| | | |
|---|---|---|
| DE | 2829380 | 1/1980 |
| DE | 2935529 | 3/1981 |
| FR | 2336954 | 7/1977 |
| FR | 2473457 | 7/1981 |
| NL | 8104783 | 5/1983 |

OTHER PUBLICATIONS

U.S. patent application Ser. No. 10/321,392 (Metrot), filed on Dec. 18, 2002.

* cited by examiner

*Primary Examiner*—Sherman Basinger
(74) *Attorney, Agent, or Firm*—Greenblum & Bernstein, P.L.C.

(57) ABSTRACT

A method for manufacturing a structural sub-assembly for a gliding board, such as a surfboard, as well as a method for manufacturing such gliding board, the method including at least: forming at least two shell elements, and assembling shell elements with a resin foam. The invention is also directed to the sub-assembly and to the gliding board formed by such methods.

30 Claims, 5 Drawing Sheets

FIG.1
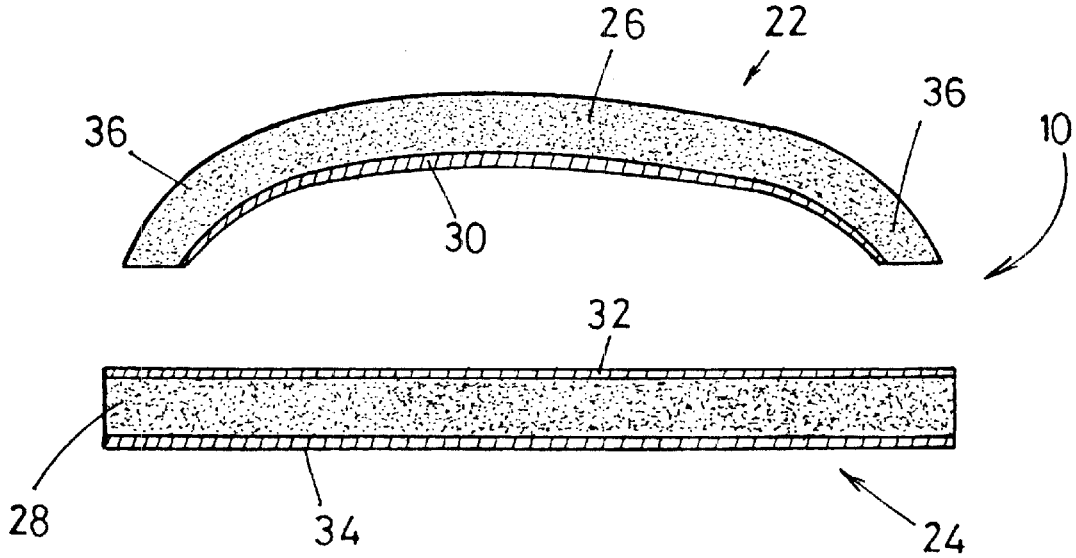
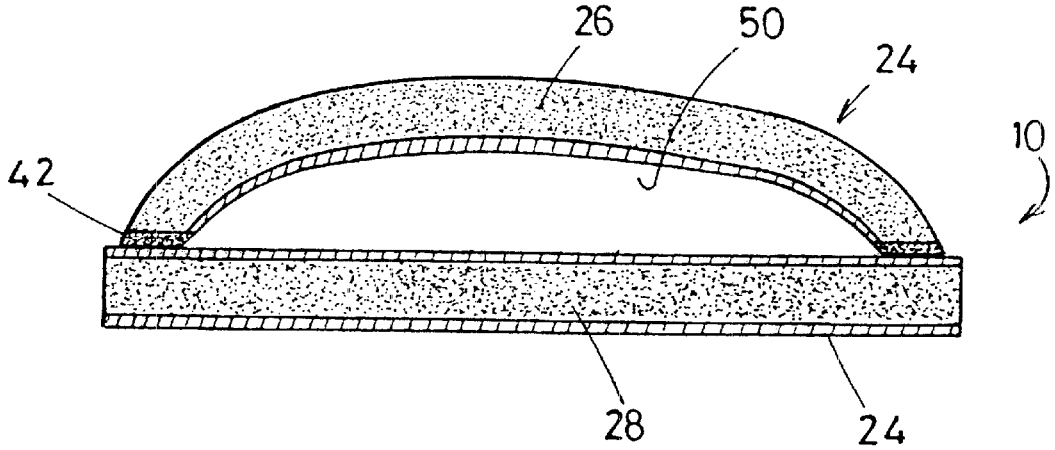
FIG.2

FIG.9
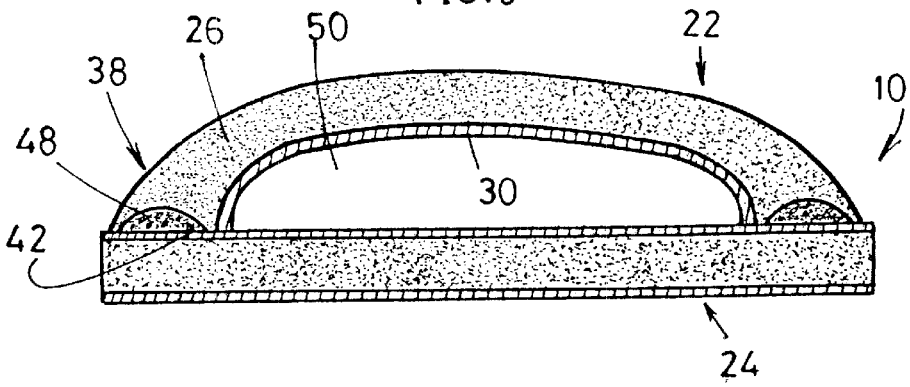
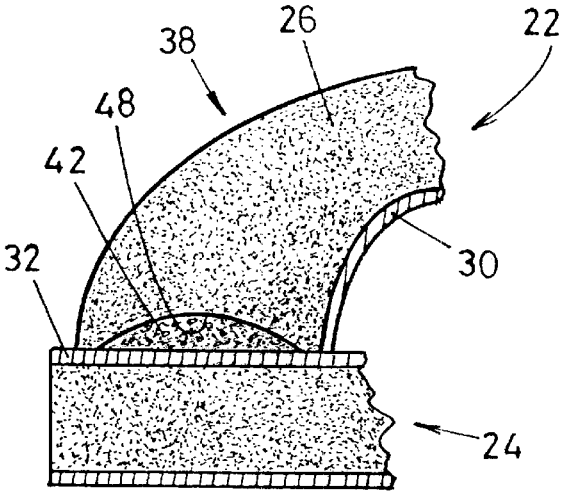
FIG.10
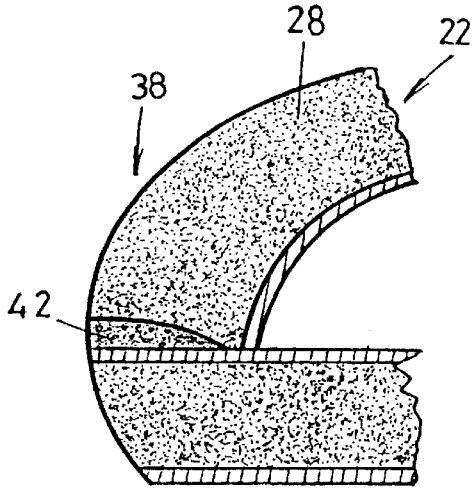
FIG.11

FIG.12
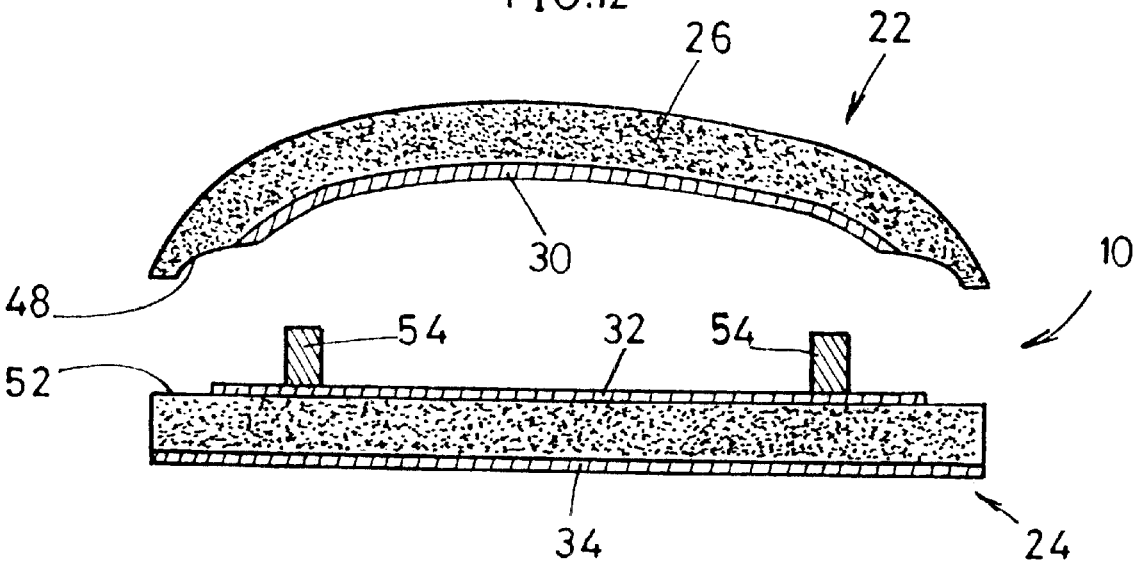
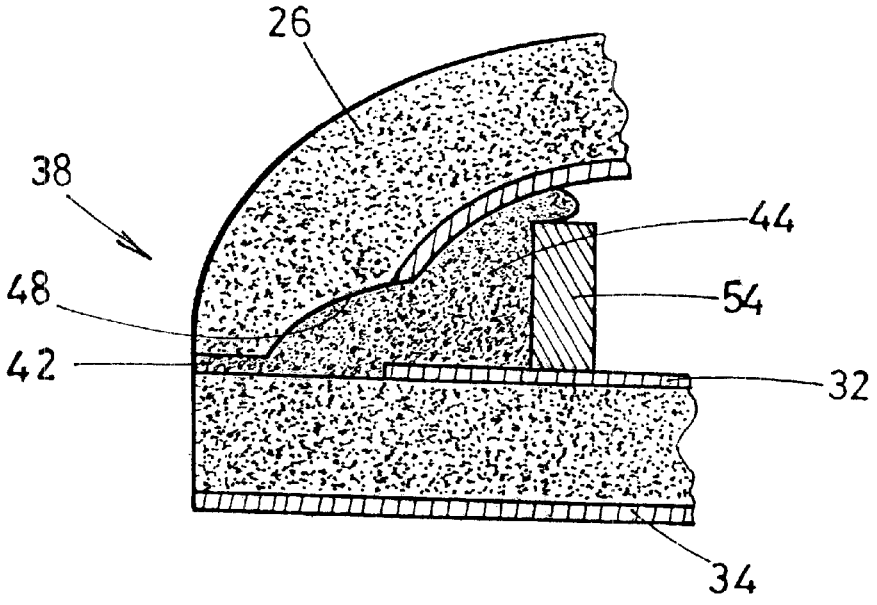
FIG.13

METHODS FOR MANUFACTURING A STRUCTURAL SUB-ASSEMBLY AND A GLIDING BOARD; STRUCTURAL SUB-ASSEMBLY AND GLIDING BOARD MADE BY SUCH METHODS

CROSS-REFERENCE TO RELATED APPLICATION

This application is based upon French Patent Application No. 01.16965, filed Dec. 19, 2001, the disclosure of which is hereby incorporated by reference thereto in its entirety, and the priority of which is hereby claimed under 35 U.S.C. §119.

BACKGROUND OF THE INVENTION

1. Field of the Invention

The invention relates to a sub-assembly provided to make a gliding board, particularly a board for gliding on water, such as a surfboard float.

The invention also relates to a method for manufacturing such sub-assembly, and a gliding board made from such sub-assembly.

2. Description of Background and Relevant Information

Conventionally, a surfboard float is made from a foam blank, particularly a polyurethane foam, which is formed in a mold. The foam blank is machined by planing and sanding over a low thickness to locally customize its shape, then it is coated with an envelope made of resin-impregnated fiberglass that forms an outer reinforcement shell and gives the float its final form. Decorating and glassing give the float its final aspect.

In certain cases, the foam blank is longitudinally cut in two sections that are then glued against a wooden stringer that reinforces its structure and imparts to it a predetermined longitudinal camber.

The drawback to such a constructional technique is the weight of the final float. Indeed, the foam is relatively dense, its typical density is 50 kg/m3. And theoretically, it is not possible to decrease the density of the foam without negatively affecting the mechanical properties of the float.

According to another constructional technique originating from windsurfing, one starts with a foam blank having a relatively low density (for instance, 18 kg/m3) which is machined to shape. This blank is covered with a skin made of resin-impregnated fiberglass. An envelope of foam having a higher density is attached around this sub-assembly. Then, one applies webs of resin-impregnated fiberglass in order to form the outer shell.

Such a constructional method allows for a weight reduction of approximately 20% or more while maintaining a good rigidity underfoot. However, its implementation is relatively complex. In addition, the central foam blank is usually made of expanded polystyrene foam. This material has the defect of taking in water. During its lifetime, the float may be thrown against a reef or a rock. If the outer shell is damaged, one runs the risk of water infiltrations, the water weighing down the float and being rather difficult to evacuate.

Lastly, it is known to make hollow floats having sandwich skins. Either one makes two half-shells that are then assembled together, or one makes the assembly in a closed mold with an inner bladder that is inflated in order to push and press the sandwich skins against the walls of the mold. In any case, these types of floats have walls of constant thickness.

This manufacturing technique provides results in the production of light-weight boards. However, it is not possible to customize the form of the float. In this case, the form of the outer shell depends exclusively on the form of the mold.

SUMMARY OF THE INVENTION

According to the invention, an improved sub-assembly is provided which enables the manufacture of lighter-weight gliding boards, ones that have a greater volume for an equal weight, while maintaining a form that can be customized.

More particularly, according to a method of the invention, a structural sub-assembly for a gliding board is manufactured by a method that includes the following:

forming two half-shells;

assembling the two half-shells by means of an adhesive resin foam.

BRIEF DESCRIPTION OF THE DRAWINGS

The invention will be better understood from the following description, with references to the attached drawings related thereto, and in which:

FIGS. 1 and 2 schematically show, in a transverse cross-section, an embodiment of a structural sub-assembly having two half-shells assembled according to the invention, respectively before and after gluing;

FIGS. 9–11 are views similar to those of FIGS. 2–4 showing an alternative embodiment of the invention;

FIGS. 12 and 13 are views similar to those of FIGS. 1 and 3 showing yet another embodiment of the invention.

DETAILED DESCRIPTION OF THE INVENTION

Figure 3:
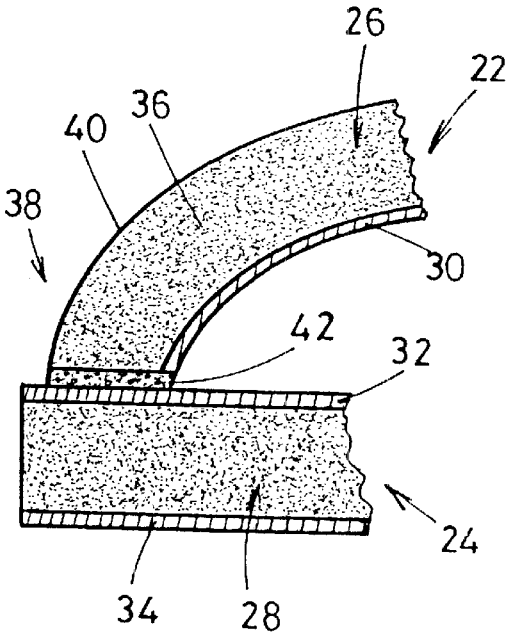
FIGS. 3 and 4 are schematic views showing a detail of FIG. 2, respectively before and after machining the lateral rails of the sub-assembly.

As known, a surfboard float is an elongated board having a central portion, a tapered and slightly raised front tip, and a slightly raised rear tail that has a decreased width.

FIGS. 1–4 show a first embodiment of the invention in which a structural sub-assembly is made from two assembled half-shells. In the example shown, the sub-assembly is a hollow sub-assembly constructed according to a sandwich technology. Such a particularly light sub-assembly is used advantageously in manufacturing a surfboard float. For other types of gliding boards, the invention can be implemented with other embodiments of the sub-assembly.

The sub-assembly 10 can thus be formed of an upper half-shell 22 that will form the final float deck and of a lower half-shell 24 that will form the hull. Each half-shell is formed of a foam plate 26, 28 that is shaped first. Depending on the type of foam used, this shaping can use various techniques. The foam used, for example, can be an extruded polystyrene foam that is generally in the form of a flat plate and that can be shaped by thermoforming to become a shaped plate, as illustrated in the figures. In the example shown, this shaped plate 26 is covered, on an inner surface 30, 32, with at least one inner envelope layer (for example, a fabric made of fiberglass, carbon fibers or another fibrous material impregnated with a polyester or epoxy resin, or the like). In the example shown, the operation for laminating the inner surface 30, 32 of the half-shells 22, 24 can be advantageously performed under vacuum while the previously thermoformed foam plate 26, 28 is still in the thermoforming mold, so that the resin-coated layer of fabric can harden on the thermoformed plate while the latter is still pressed against the mold. The form of the half-shell is thus better guaranteed before assembly.

When the two half-shells 22, 24 are assembled together, for example, by gluing, one directly obtains a hollow rigid inner shell that is formed of resin-coated fabric layers arranged on the inner surfaces of the half-shells, on the one hand, and by an external foam envelope capable of being machined, on the other hand. The foams used, for example, can be extruded polystyrene foam plates having a density on the order of 30–50 kg/m$^3$. The sub-assembly achieved, therefore, has at least one hollow inner portion 50 that gives it a substantial lightness without sacrificing its rigidity.

In order to implement this embodiment of the invention, it can be advantageous to provide for one of the half-shells, for example, the lower half-shell 24, to be also laminated on its outer surface 34 before assembling the two half-shells. The half-shell thus laminated on its two surfaces 32, 34 is then particularly rigid during assembly with the other half-shell, which allows better control of the precision of the assembly and, therefore, a better control of the precision of the form of the sub-assembly. The foam envelope covering the shell is then no longer capable of being machined over its entire area. Indeed, since one of the surfaces is already laminated at the time of assembly, the geometry of this surface can no longer be substantially modified. Nevertheless, it has been noted that, in order to substantially modify the final behavior of the gliding float, it is often sufficient to modify the geometry of the lateral edges of the float (generally called the rails of the float). However, this geometry can be modified even if one of the outer surfaces of the float (for example, the lower surface), is already laminated.

In the example shown in FIGS. 1–4, one can see that the two half-shells are not symmetrical. Indeed, one can see that the lower half-shell 24 does not have lateral edges. During its shaping, the foam plate 28 is curved in the longitudinal direction (which is not shown in the drawings) to follow the longitudinal camber curve (sometimes called a "rocker" or a "scoop" curve). It could also be curved in the transverse direction, for example, to form a V-shaped hull that is concave or double concave. However, in the example shown, the lower half-shell does not have a transverse curve. In this case, because the deformation of the foam plate as compared to its initial planar state is relatively small, the shaping of the plate can occur without thermoforming, by simply pressing the plate against the mold by depression at the time of lamination. After the resin hardens, the rigidity of the resin-coated fabric 32 suffices to maintain the plate to the desired shape of the half-shell.

Conversely, the upper half-shell 22 is thermoformed so as to be curved longitudinally but also transversely to form lateral edges 36 that are curved downwardly. According to the invention, the inner surfaces (i.e., the lower surface 30 of the upper half-shell 22 and the upper surface 32 of the lower half-shell 24) are laminated with one or several fabric layers made of a fibers impregnated with a thermosetting resin. As can be seen in FIG. 1, the lower surface 34 of the lower half-shell 24 is also laminated before assembling the two half-shells.

As can be seen in FIG. 2, the assembly of the two half-shells is obtained by arranging glue 42 in the interface zone constituted of the lower edge of the lateral edges 36 of the upper half-shell 22, on the one hand, and of the corresponding peripheral portion of the upper surface 32 of the lower half-shell 24, on the other hand.

According to the teachings of the invention, gluing is obtained by means of an adhesive resin foam, for example, a polyurethane foam. For example, a polyurethane foam such as MDI (Methyl-Diphenyl-Isocyanate) can be chosen, which has a polyol/isocyanate ratio (in weight) on the order of 100/140 or on the order of 100/110. The foam will have, for example, a free expansion density on the order of 25–200 kg/m$^3$. The density of the resin in the area of the interface of the two half-shells can be more substantial due to the compression effect. According to a particular non-limiting embodiment, the resin can be applied while in liquid form so as to allow a perfect coupling of the two half-shells. The two half-shells would then be maintained pressed against each other while the resin is setting to avoid any risk of deformation due to swelling of the foamy adhesive resin during its expansion.

One can also use other types of adhesive resin foams, such as, for example, epoxy foams, having a slightly higher free expansion foam density. In any case, the adhesive resin foam can be colored, if desired.

With this construction, one can see in FIG. 3 (which shows in more detail the lateral edge of the sub-assembly right after assembly) that the top largest portion of the lateral ledge 38 of the structural assembly is formed of the lateral edges 36 of the upper half-shell whose outer surface 40 is constituted of foam. The lower portion of these lateral edges is constituted of the lateral side edge of the lower half-shell, the latter having a foam thickness 28 surrounded (on top and on bottom) by two thicknesses of resin-impregnated fabric layers 32, 34. Since the thicknesses of the fabric layers 32, 34 are very low, they do not form an obstacle to the shaping by machining at the lateral edges.

Between the lower and upper portions of these lateral edges, one can see the glue line that is obtained by means of the adhesive resin foam 42. Because, as seen in transverse cross section in FIG. 3. e.g., the lower edges 36 of the foam 26 are exposed, a direct contact is provided between a surface of the foam 26 and the adhesive resin foam 42. Due to the structure of this gluing material, i.e., adhesive resin foam. Which is very close to that of the foam which is to be machined, one avoids the presence of a particularly hard layer which would be due to the overlaying of a compact and rigid layer of glue, such as, for example, an epoxy glue, on the laminated upper surface 32 of the lower half-shell 24.

Figure 4:
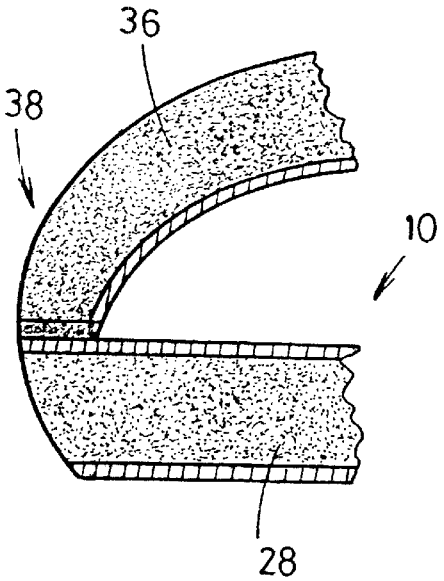

Thus, in FIG. 4, one can see that the geometry of the lateral edge 38 of the structural sub-assembly has been modified over the entire height of the lateral edge 38, for example, by planing and sanding.

However, in an alternative embodiment, one could make the peripheral portion of the upper surface 32 of the lower half-shell 24 without a lamination, such that the lateral edges 36 of the upper half-shell 22 are assembled by the foam glue line 42 directly against the foam 28, in order to ensure a better continuity of the material forming the lateral edge 38 that, due to the invention which provides using a adhesive resin foam, is therefore only constituted of foam. Such a feature exists in the embodiment described hereinbelow in relation to FIGS. 12 and 13.

The lamination of one of the outer surfaces of the sub-assembly 10, in this case the lower surface 34 of the lower half-shell 24, can be complete (as shown). Also, it can relate to only a portion of the surface 34, for example, the central portion, to further improve the machinability of the lateral edge 38.

With this construction, the precise assembly of the two half-shells is facilitated by the great rigidity of the lower half-shell, and the sub-assembly remains capable of being machined over its entire upper surface and over its lateral edges, allowing a great capacity for customizing the sub-assembly. Once customized, the structural sub-assembly is covered with an outer envelope, for example, a layer of resin-impregnated fibers to form the gliding board. As the case may be, one can choose to also cover the outer surface 34 of the sub-assembly, that is already laminated, with this outer layer so as to increase the rigidity and the solidity of the float or, on the contrary, one can choose not to cover this surface 34, that is already laminated, in order to limit the weight of the float.

In the case where one wishes to promote the possibility of customizing the float hull, one could provide for the half-shell that is laminated on its two surfaces to be the upper half-shell, the lower half-shell then being laminated only on its upper surface 32. Optionally, a portion of this envelope (whose geometry one does not wish to modify, for instance, the upper surface of the upper half-shell or the lower surface of the lower half-shell) can be covered with a rigid external layer.

To improve its rigidity further, one can advantageously provide the structural sub-assembly of FIGS. 1–4 with a longitudinal central partition that vertically connects the two half-shells, such a partition being furthermore known to one skilled in the art as a stringer. Such a central partition is for example made of foam or of wood. The partition can be edged with two layers made of resin-impregnated fibers that eventually connect continuously to the wall of the shell.

The present description is given only by way of example, and one could adopt other embodiments thereof without leaving the scope of the present invention, for example, by using several-longitudinal, transverse or otherwise appropriately directed partitions, these partitions forming linkages between the deck and the hull of the float. These partitions can possibly create a partitioning of the inner shell into several waterproof compartments.

The sub-assembly according to this first embodiment can be machined in the same manner as a conventional foam blank, depending on what the shaper wishes, as long as the machining thickness remains distinctly smaller than the foam thickness.

The two embodiments shown in FIGS. 5–8 have the advantage of allowing a greater machining depth without risking a substantial decrease in the mechanical strength of the sub-assembly.

Figure 5:
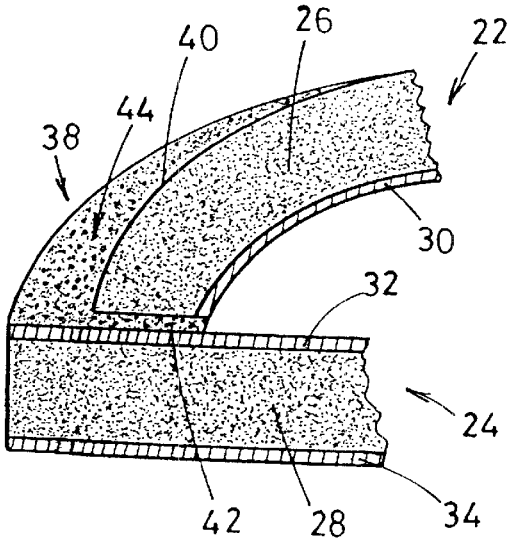
FIGS. 5 and 6 are views similar to those of FIGS. 3 and 4 showing an alternative embodiment of the invention in which the foam glue is spread so as to form an excess thickness on the exterior of the sub-assembly.
Figure 6:
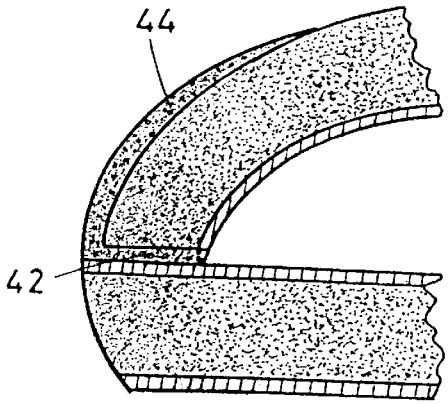

Indeed, in the second embodiment shown in FIGS. 5 and 6, one can see that the foamy adhesive resin 42 is not laid only on the interface of the two half-shells, but it is on the contrary laid so as to form an excess thickness 44 on the exterior of the sub-assembly along the entire length of the lateral edge 38 thereof.

The shape of this excess thickness can be defined with precision by means of a mold applied along the lateral edge 38. This mold can be part of a tool ensuring the correct positioning of the two half-shells during assembly. The shape of the excess thickness can also be given by a depressurized flexible enclosure in which the subassembly is enclosed so as to exert the pressure necessary for gluing on the half-shells. In both cases, the foam that forms the excess thickness is therefore compressed. Conversely, one can also allow the resin foam to expand freely. In the example shown, the excess thickness extends first of all along the outer surface 40 of the upper half-shell (one can see that the thickness of the excess thickness of glue progressively decreases as one moves away from the interface zone), and secondly over a portion of the upper surface 32 of the lower half-shell 24 that, in this example, projects transversely toward the exterior in relation to the upper half-shell 22. One could provide for this projection to be less pronounced or even non-existent, in which case the excess thickness would also extend along the side edge of the lower half-shell 24.

Because the excess thickness 44 is constituted of foam, it is easily machined, and the increase in foam thickness that it forms allows greater freedom in the choice of the final geometry of the lateral edge 38 after machining, as the latter maintains a thickness that is substantially equivalent to that of the non-machined portions of the subassembly. Thus, the float is not embrittled.

Advantageously, the gluing of the two half-shells and the forming of the excess thickness will occur during a single operation. Nonetheless, one can choose in certain instances to execute these two operations successively.

Another advantage of making these excess thicknesses with the adhesive resin foam lies in the fact that one thus increases the gluing surface between the two half-shells and, therefore, the strength of the assembly.

Figure 7:
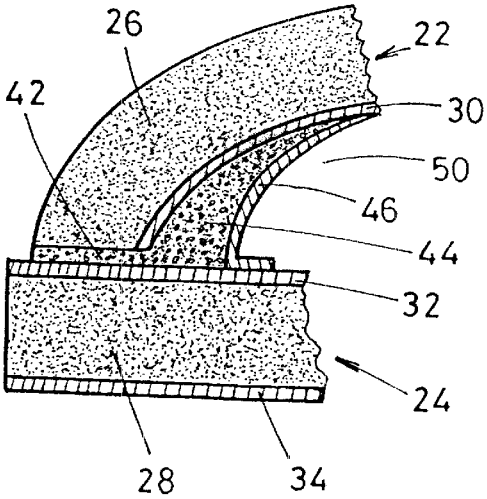
FIGS. 7 and 8 are views similar to those of FIGS. 3 and 4 showing an alternative embodiment of the invention in which the foam glue is spread so as to form an excess thickness on the interior of the sub-assembly that, at least in this embodiment, is hollow.
Figure 8:
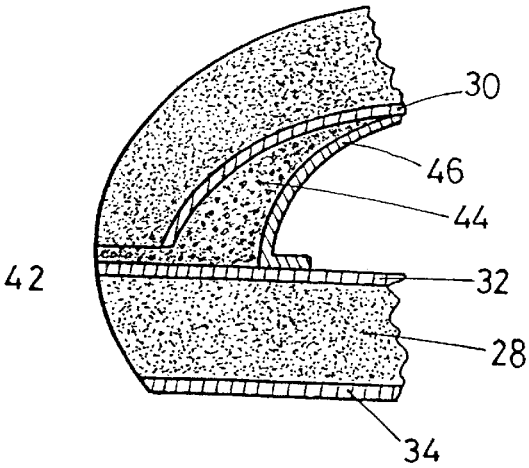

In the embodiment shown in FIGS. 7 and 8, the excess thickness 44 is obtained on the inner side of the interface. It is naturally assumed then that the structural subassembly is hollow, i.e., the shell elements 22 demarcate at least one hollow inner portion 50. In this embodiment, one can either let the excess thickness expand freely, or one can confine it by means of a strip 46 of resin-impregnated fabric, for instance, that connects the upper surface 32 of the lower half-shell 24 to the lower surface 30 of the upper half-shell. This strip 46 thus forms a confinement partition that prevents the foamy adhesive resin from extending too much toward the interior of the cavity of the hollow body. It also allows ensuring, through the pressure due to the expansion of the foamy resin, a complete contact between the excess thickness 44 and the two half-shells. When the excess thickness 44 of glue is in the hollow inner portion 50, one can see in FIG. 8 that it is not affected by the final machining of the sub-assembly 10. As a result, the excess thickness 44, if it has a substantial volume and/or weight, can influence the mechanical behavior of the final board (particularly the flexional and torsional stiffness), but it can especially modify the distribution of weight and inertia of the board, thereby modifying its dynamic behavior. The size of the excess thickness can be made to vary along the periphery of the board so that, for example, it is non-existent in certain areas and conversely very substantial in others.

The embodiments shown and described hereinabove are constructed on the basis of a structural sub-assembly in which each half-shell is formed from a thermoformed sheet of foam having a substantially constant thickness.

In the alternative embodiment of FIGS. 9–11, the technique for constructing the upper half-shell 22 is slightly different in order to allow one to very easily obtain an upper half-shell 22 having, in the area of its lateral edges 38, a foam thickness 26 that is greater than the foam thickness of the float deck, at least prior to machining the lateral edges 38. Thus, one can choose to make the foam layer 26 of the upper half-shell 22 by molding, this molded layer 26 then being covered on its lower surface with a laminated inner layer 30. This construction has a double advantage: on the one hand, it gives an increased foam thickness allowing more freedom at the time of machining to obtain the desired form and, on the other hand, it increases the area of the interface zone used for gluing, which reinforces the solidity of this gluing.

To increase the gluing area even further, one can see that the side edge of the upper half-shell 22 forming part of this interface is not flat. It has a recess 48 whose cross-section can be semi-elliptic as shown, but which can also have other profiles. The contact surface between the glue 42 and the upper half-shell 22 is therefore increased. Due to the fact that the glue is a foaming resin that expands, one is certain that the recess 48 is completely filled by the glue that comes in contact with the wall demarcating this recess. Gluing is therefore optimal.

After machining and as can be seen in FIG. 11, there is a thickness in the foam envelope 28 that is substantially equivalent, along the lateral edge 38, to what it is on the rest of the half-shell 22. Thus, machining does not create a weakening of the structural sub-assembly. In the case where a recess 48 of the interface has been provided, one can see that machining reveals a portion of the glue line 42 whose thickness is relatively substantial. The fact that the glue line is made by means of a foamy and therefore easily machinable material is particularly important here in order to make possible an easy shaping of the lateral edge 38.

FIGS. 12 and 13 show an embodiment of the invention that has some of the features that have already been described. The upper half-shell 22 is formed of a foam plate 26 whose thickness is substantially constant and which is laminated on its inner surface 30. The lower half-shell 24 is laminated on its two surfaces 32, 34, but one can note that the peripheral edge 52 of the upper surface 32 is not laminated, such that the gluing of the two half-shells occurs foam-to-foam. The side edge of the upper half-shell, which is adapted to be opposite the peripheral edge 52 of the lower half-shell 24, has a recess 48 similar to the one described in the previous embodiment. In this case, the recess 48 is formed only on the inner side of the side edge, i.e., on the side of the inner cavity 50. In this embodiment, it is provided to make an excess thickness 44 on the inner side of the glue line 42, i.e., in the inner cavity 50. In order to keep the excess thickness from overly extending transversely toward the interior of the cavity, a confinement partition 54 forming a barrier along the contour of the board has been arranged, for example, on the inner surface 34 of the lower half-shell 24. This confinement partition 54 can have a height that is lower than the height of the cavity 50 in the corresponding zone such that it does not come in contact with the upper half-shell 22 as seen in FIG. 13. This alternative is advantageous in terms of ease of manufacture, since there is no specific height tolerance to be kept for the confinement partition. On the contrary, one could provide for this confinement partition to be adjusted in height to come barely into contact with the upper half-shell. If it is more restrictive in terms of manufacturing, this alternative has the advantage of conferring to the confinement partition an additional function of vertical reinforcement and stiffening in addition to its first function of confining the glue line. This confinement partition can be made from a block of foam that is cut to the desired shape, or from a cord of foam that is allowed to expand freely on the inner surface 34. It can also be made in the form of a plate element made from a rigid material, for instance, wood, or a sandwich material. One can arrange a confinement partition along the entire interface between the two shell elements or, conversely, one can provide partition sections only along certain zones of the interface. In any case, the confinement partition demarcates, in the vicinity of the gluing interface, a predetermined volume that the glue foam fills when expanding, thus coming into contact with the inner surfaces 30, 32 of the two half-shells.

Once assembled, this embodiment shows the advantage that the contact surfaces of the glue foam with the two half-shells are very important. In particular, a good contact between the glue and the upper half-shell 22 is ensured due to the confinement partition 54. Furthermore, the non-laminated peripheral edge 50 and the inwardly off-centered recess 48 make it very easy to machine the lateral edge 38 that is almost exclusively composed of foam.

Finally, once shaped, the structural sub-assembly with its machined foam layer is provided to be covered with an outer envelope. This outer envelope is preferably a web 9 (woven or non-woven) of fiberglass or the like covered with a resin, and it can receive the finishing operations in the same manner as a conventional float. One thus obtains a particularly efficient gliding board. Nevertheless, the outer envelope can be made differently, for example, by simple thermoforming of two sheets of thermoplastic material, as is known particularly in the field of windsurfing floats.

The invention has just been described for a sub-assembly formed solely of two shell elements, but it can be transposed effortlessly should the sub-assembly be composed of more than two shell elements. Likewise, a sub-assembly can have several of the aspects of the invention described hereinabove one by one, for instance, an excess thickness of glue both on the inner side as well as on the outer side, or an excess thickness of glue on the inner side combined with a recess of the side edge of the interface, etc. In addition, the invention could be applied to the construction of gliding boards other than surfboard floats, for example, for windsurfing floats, for floats adapted for swimming in waves and, in general, for any nautical activity in which the float functions primarily in the lift mode.

What is claimed is:

1. A method for manufacturing a structural sub-assembly for a gliding board, comprising:

forming at least two shell elements, each of the two shell elements comprising a foam material;

assembling the two shell elements with an adhesive resin foam, the adhesive resin foam being laid on an interface between the two shell elements and around an interface so as to form an excess thickness.

2. A method according to claim 1, wherein the excess thickness of the adhesive resin foam is applied to in a zone of the two shell elements adapted to be machined after assembling the shell elements.

3. A method for manufacturing a structural sub-assembly for a gliding board, comprising:

forming at least two shell elements, each of the two shell elements comprising a foam material;

assembling the two shell elements with an adhesive resin foam, the assembled shell elements demarcating a hollow inner portion the adhesive foam being laid so as to form an excess thickness on a side of the hollow inner portion.

4. A method according to claim 3, further comprising arranging, on the interior of the hollow inner portion, at least one confinement partition adapted to limit expansion of the excess thickness of the adhesive resin foam.

5. A method according to claim 4, wherein the confinement partition is arranged in proximate to an interface between the two shell elements.

6. A method according to claim 1, wherein the excess thickness of adhesive resin foam extends on both sides of the contact interface of the shell elements.

7. A method according to claim 1, wherein the excess thickness extends along at least one portion of a contour of the interface.

8. A method for manufacturing a structural sub-assembly for a gliding board, comprising:

forming at least two shell elements, each of the two shell elements comprising a foam material;

assembling the two shell elements with an adhesive resin foam;

the sub-assembly being formed of the two shell elements, each of the two shell elements having a form of a plate, at least one of the two plates being curved; and an interface between the two shell elements being formed of a surface of one of the plates and of the side edge of another of the plates.

9. A method according to claim 8, wherein the two shell elements are covered, on an inner surface, with a layer of rigid composite material.

10. A method according to claim 9, wherein the interface of the two shell elements lack a rigid composite material.

11. A method according to claim 1, wherein the form of the excess thickness of adhesive resin foam is defined, during the expansion of the foam resin, by a mold element.

12. A method according to claim 1, wherein a zone of the two shell elements is adapted to be machined after assembly, said zone of the two shell elements being at lest partially composed of a foam.

13. A method according to claim 12, wherein the zone of the two shell elements adapted to be machined is at least partially composed of a polyurethane foam.

14. A method according to claim 12, wherein the zone of the two shell elements adapted to be machined is at least partially composed of an epoxy foam.

15. A structural sub-assembly for a gliding board, said structural sub-assembly comprising:

at least two shell elements, each of the two shell elements comprising a foam material;

the two shell elements being assembled together with an adhesive resin foam, the adhesive resin foam being laid on an interface between the two shell elements and around the interface so as to form an excess thickness.

16. A structural subassembly for a gliding board, said structural sub-assembly comprising:

at least two shell elements, each of the two shell elements comprising a foam material;

the two shell elements being assembled together with an adhesive resin foam and forming at least one hollow inner portion;

the adhesive resin foam being laid so as to form an excess thickness on a side of the hollow inner portion.

17. A structural subassembly according to claim 16, further comprising, inside the hollow inner portion, at least one confinement partition adapted to limit expansion of the excess thickness of adhesive resin foam.

18. A structural subassembly according to claim 17, wherein the confinement partition is arranged proximate an interface between the two shell elements.

19. A method for manufacturing a structural sub-assembly for a gliding board, comprising:

forming at least two shell elements, each of said two shell elements comprising a foam material;

assembling together said two shell elements with an adhesive resin foam, at least one interface between said two shell elements, created during said assembling, being formed between a surface of said foam material of one of said two shell elements and said adhesive resin foam.

20. A method according to claim 19, wherein said forming at least two shell elements comprises forming a deck and a hull.

21. A method according to claim 20, wherein said interface is between a lower edge of said deck and an upper surface of said hull.

22. A method for manufacturing a gliding board, comprising:

at least partially machining an outer surface of a foam material of at least one of a plurality of shell elements of a structural sub-assembly, said shell elements having been assembled together with an adhesive resin foam, until an amount of said foam material of said at least one of said plurality of shell elements is removed until a desired shape of the sub-assembly is obtained;

covering the machined sub-assembly with an outer covering.

23. A method according to claim 22, wherein said machining comprises planing and/or sanding.

24. A method according to claim 23, wherein said machining comprises planing and/or sanding an exposed portion of said adhesive resin foam while planing and/or sanding said outer surface of said foam material of at least one of said plurality of shell elements.

25. A method according to claim 23, wherein said covering the machined sub-assembly with an outer covering comprises covering the machined sub-assembly with an outer covering of fabric/resin material.

26. A method for manufacturing a structural sub-assembly for a gliding board, comprising:

forming at least two shell elements;

assembling the two shell elements with an adhesive resin foam, the adhesive resin foam being laid on an interface between the two shell elements and around an interface so as to form an excess thickness.

27. A method for manufacturing a structural sub-assembly for a gliding board, comprising:

forming at least two shell elements demarcating a hollow inner portion;

assembling the two shell elements with an adhesive resin foam, the adhesive foam is laid so as to form an excess thickness on a side of the hollow inner portion.

28. A method for manufacturing a structural sub-assembly for a gliding board, comprising:

forming at least two shell elements;

assembling the two shell elements with an adhesive resin foam;

the sub-assembly being formed of the two shell elements, each of the two shell elements having a form of a plate, at least one of the two plates being curved, and an interface between the two shell elements being formed of a surface of one of the plates and of the side edge of another of the plates.

29. A structural sub-assembly for a gliding board, said structural sub-assembly comprising:

at least two shell elements assembled together with an adhesive resin foam;

the adhesive resin assembly being laid on an interface between the two shell elements and around the interface so as to form an excess thickness.

30. A structural sub-assembly for a gliding board, said structural sub-assembly comprising:

at least two shell elements assembled together with an adhesive resin foam to demarcate a hollow inner portion;

said adhesive resin foam being laid so as to form an excess thickness on a side of the hollow inner portion.

* * * * *